US006474283B1

(12) United States Patent
Gidlund

(10) Patent No.: US 6,474,283 B1
(45) Date of Patent: Nov. 5, 2002

(54) VALVE LASH SETTING METHOD AND DEVICE FOR EXECUTING THE METHOD

(75) Inventor: Per Adolf Lennart Gidlund, Shelby Township, MI (US)

(73) Assignee: Atlas Copco Tools AB, Stockholm (SE)

( * ) Notice: Subject to any disclaimer, the term of this patent is extended or adjusted under 35 U.S.C. 154(b) by 0 days.

(21) Appl. No.: 10/023,626

(22) Filed: Dec. 18, 2001

(51) Int. Cl.[7] ..... F01L 1/20; G01M 15/00

(52) U.S. Cl. ..... 123/90.45; 123/90.52; 73/119 R; 33/611; 81/9.24

(58) Field of Search ..... 123/90.42, 90.45, 123/90.52; 29/888.43, 888.46; 81/9.24; 33/611; 73/119 R

(56) References Cited

U.S. PATENT DOCUMENTS 3,717,053 A * 2/1973 Sturges ..... 81/9.24
3,988,925 A * 11/1976 Seccombe et al. ..... 73/119 R
4,221,199 A * 9/1980 Buuck et al. ..... 123/90.16
6,205,850 B1 * 3/2001 Wehrman et al. ..... 73/119 R

* cited by examiner

*Primary Examiner*—Weilun Lo
(74) *Attorney, Agent, or Firm*—Frishauf, Holtz, Goodman & Chick, P.C.

(57) ABSTRACT

A method and a device for setting the valve lash to a desired value at I.C. engines, including application of a motor driven coaxial double spindle (22) on each valve adjusting screw (18) and lock nut (19) followed by a number of consecutive operation steps comprising: tightening the adjuster screw (18) of each valve (11;111) to a snug torque level ($T_s$), open the valve (11;111) by tightening the adjuster screw (18) through a predetermined angle while checking the torque magnitude required therefor, reverse the adjuster screw (18) through an angle exceeding the previous predetermined angle, re-tighten the adjuster screw (18) to the snug torque level ($T_s$), reverse the adjuster screw (18) through an angular interval corresponding to the desired valve lash, and tighten the lock nut (19) while holding the adjuster screw (18) stationary.

15 Claims, 3 Drawing Sheets

VALVE LASH SETTING METHOD AND DEVICE FOR EXECUTING THE METHOD

This invention relates to a technique for setting the valve lashes in a piston type I. C. engine wherein each valve is operated via a mechanism including an adjuster screw with a lock nut.

Previous methods and devices for this purpose include the use of feeler gauges and/or displacement sensing probes for indicating and verifying the valve lash settings. The equipment for carrying out these prior art methods suffer from an undesirable sensitiveness to environmental factors like: vibrations, dirt, variations in temperature etc. which are usually prevailing at the assembly lines for engines of the above type. The result has been an unacceptably poor accuracy and reliability of the lash settings.

The main object of the invention is to provide an improved technique for accomplishing a simple and reliable valve lash setting, which is less sensitive to environmental factors and which give a reliable and accurate result.

Further characteristic features and advantages of the invention will appear from the following specification and claims.

Preferred embodiments of the invention are described below in detail with reference to the accompanying drawings.

In the drawings:

FIGS. 1*a–c* illustrate three sequential setting positions of a twin-valve arrangement by a method according to the invention.

FIGS. 2*a–c* illustrate three sequential setting positions of a single-valve arrangement by a method according to the invention.

As mentioned above, the valve lash setting method and device according to the invention means an improvement and simplification in relation to previous techniques for this purpose. This is obtained in that the new technique is based on the use of a co-axial double spindle only and does not use gauges and probes for detecting and verifying the lash setting results. Thereby, the problems of undesirable sensitiveness to disturbing factors like: vibrations, dirt, temperature changes etc. are eliminated.

In order to ensure a proper closure of the valves visavi the valve seats under all operating conditions there has to be a lash in the valve operating mechanism between the camshaft and the valves. The size of this lash depends on various factors, like the profile of the valve lifting cam, temperature related deformations of parts involved etc. and must have a very precise setting. An incorrect setting of the valve lashes results in an erroneous valve timing and a poor engine operation, and not only that, too small or non-existing valve lashes would result in burning of the valves, and too big lashes would result in a noisy valve operating mechanism. Hence, it is very important that the result of the valve lash setting operation is correct, i.e. the lashes are surely within predetermined limit values, whatever the environmental conditions may be at the working site.

Typical settings for a truck diesel engine are:

Inlet valve: 0.3–0.5 mm+/−0.1 mm

Exhaust valve: 0.6–0.8 mm+/−0.1 mm

Jake brake: 0.8–1.2 mm+/−0.1 mm

Figure 1A:
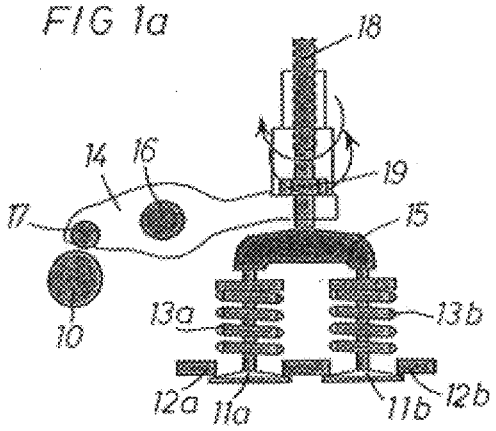
Figure 1B:
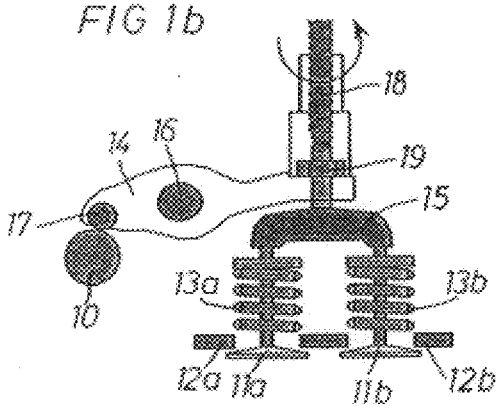
Figure 1C:
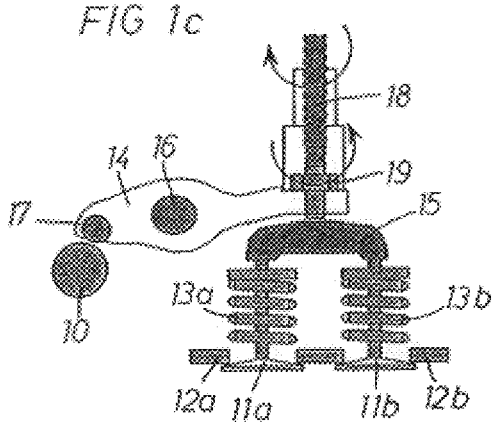

In the example illustrated in FIGS. 1*a–c,* the method is used on a diesel engine having a twin-valve arrangement for each cylinder, i.e. two inlet valves and two exhaust valves. Each pair of valves 11*a,*11*b* is operated by a cam profile 10 of an over-head camshaft. The valves 11*a,*11*b* are biassed toward valve seats 12*a,*12*b* by springs 13*a,*13*b* and are operated by the cam profile 10 via a mechanism comprising a rocker 14 and a yoke 15. The rocker 14 is pivoted on a spindle 16 and is provided at its one end with a cam follower 17 and at its opposite end with an adjuster screw 18 and a lock nut 19. The adjuster screw 18 is threaded into the rocker 14 and is arranged to transfer the valve opening force from the rocker 14 to the valves 11*a,*11*b* by abutting against the yoke 15. The lock nut 19 is threaded onto the adjuster screw 18 and arranged to be tightened against the rocker 14 to rotationally lock the adjuster screw 18.

The valve lash to be set is the total lash in the valve operating mechanism and is randomly divided into a lash between the cam profile 10 and the cam follower 17 and a lash between the adjuster screw 18 and the yoke 15. Since the rocker 14 is freely pivoted on the spindle 16 the total valve lash could be at either end of the rocker 14 or randomly divided between these two contact points.

For accomplishing a setting of the valve lashes on an engine there is used a power tool having one or more rotating double spindles 22 for setting of one valve lash at a time or more lashes at the same time. Each spindle 22 comprises a co-axial arrangement of an inner central spindle 23 and an outer hollow spindle 24 surrounding the inner spindle 23. These two spindles 23,24 are individually rotated by two motors 25,26, preferably electric motors, via drive lines 27,28, which comprise reduction gearings 29,30. The two motors 25,26 are controlled to operate selectively the adjuster screw 18 and the lock nut 19 via the spindles 23,24. The inner spindle 23 is provided with a bit 20 for engaging the adjuster screw 18, whereas the outer spindle 24 carries a nut socket 21 for engaging the lock nut 19.

The motors 25,26 are both provided with non-illustrated means for detecting the angular displacement of the individual spindles 22,23, and torque transducers for detecting the torque actually delivered via the spindles 22,23. These angle detecting means and torque transducers are connected to an operation control unit 32 for feed back of operation data. Instead of torque transducers in the spindle motors 25,26 the actual torque level could be measured as a certain current level in the respective motor drive.

The control unit 32 comprises two motor drives 33,34 and a programmable control device 35. The control unit 32 is arranged to control the output power of the motor drives 33,34 so as to operate the spindle motors 25,26 according to a certain strategy determined by the programme loaded down in the control device 35.

A suitable control unit to be used is the Power MACS marketed by Atlas Copco.

The lash setting method according to the invention is based on a specific sequence of operating the adjuster screw 18 and lock nut 19 in dependency of the adjuster screw thread pitch. The method typically comprises the following basic steps:

a) Arrange and/or check that the adjuster screw 18 is in a position where a safe valve lash exists to make sure that the lash setting operation starts from a desired condition, b) Apply the coaxial double spindle 24 on the adjuster screw 18 and lock nut 19 with the inner spindle 23 engaging the adjuster screw 18 and the outer spindle 24 engaging the lock nut 19, tighten the lock nut 19 to a predetermined torque level of 5 Nm. See FIG. 1*a.* c) Determine the mechanical lash in the power tool drive lines and spindles by first applying a reversing torque of 1.0 Nm on the adjuster screw 18 against the arresting force of the still tightened lock nut 19, and then applying a tightening torque on the adjuster screw 18 to 1.0 Nm while measuring the angular movement of the adjuster screw 18. This movement is the mechanical lash of the drive line 27 of the inner spindle 31 and shall be compensated for when determining the final valve lash, d) Loosen the lock nut 19 over for instance 60 degrees to make sure that the adjuster screw 18 is free to be operated, e) Run down the adjuster screw 18 until a snug torque level $T_s$ of 0.7+/−0.3 Nm is obtained and record the angular position of the adjuster screw 18 as the snug torque level $T_s$ is reached. This is the point $S_o$ where the lash becomes zero and the valves 11*a*,11*b* are about to open, f) Open the valves 11*a*,11*b* by turning the adjuster screw 18 over 90 degrees, while checking that the torque required therefor does not exceed 1.3 Nm, thereby ensuring that there are no obstacles for the valves 11*a*,11*b* to move freely. See FIG. 1*b*.

g) Reverse the adjuster screw 18 over 130 degrees to ensure that the process will continue from a lash condition, h) Re-tighten the adjuster screw 18 to the snug torque level $T_s$ of 0.7+/−0.3 Nm so as to obtain the valve lash zero position $S_o$ and the valves 11*a*,11*b* are just about to open, and record the angular position of the adjuster screw 18, i) Reverse the adjuster screw 18 over an angle of 170 degrees to set the desired valve lash, and j) Hold the adjuster screw 18 stationary and tighten the lock nut 19 to 30 Nm. See FIG. 1*c*.

By reversing the adjuster screw 18 over an angle of 170 degrees from the position $S_o$ represented by the snug torque level $T_s$ there is obtained the correct valve lash setting with the actual thread pitch of the adjuster screw 18.

Figure 4:
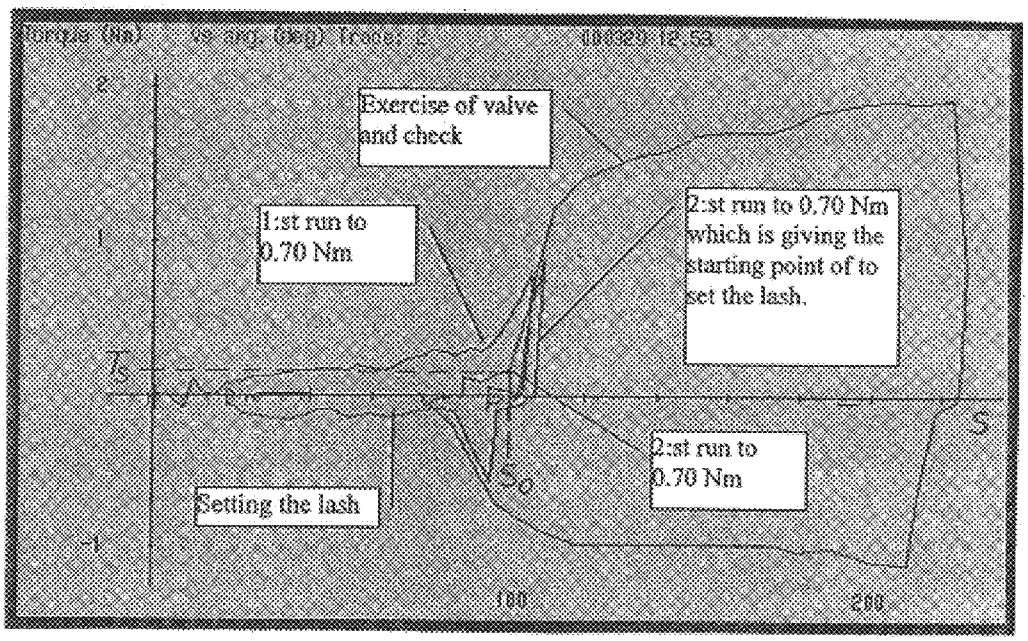
FIG. 4 shows a graph plotted during performance of the method according to the invention.
Figure 5:
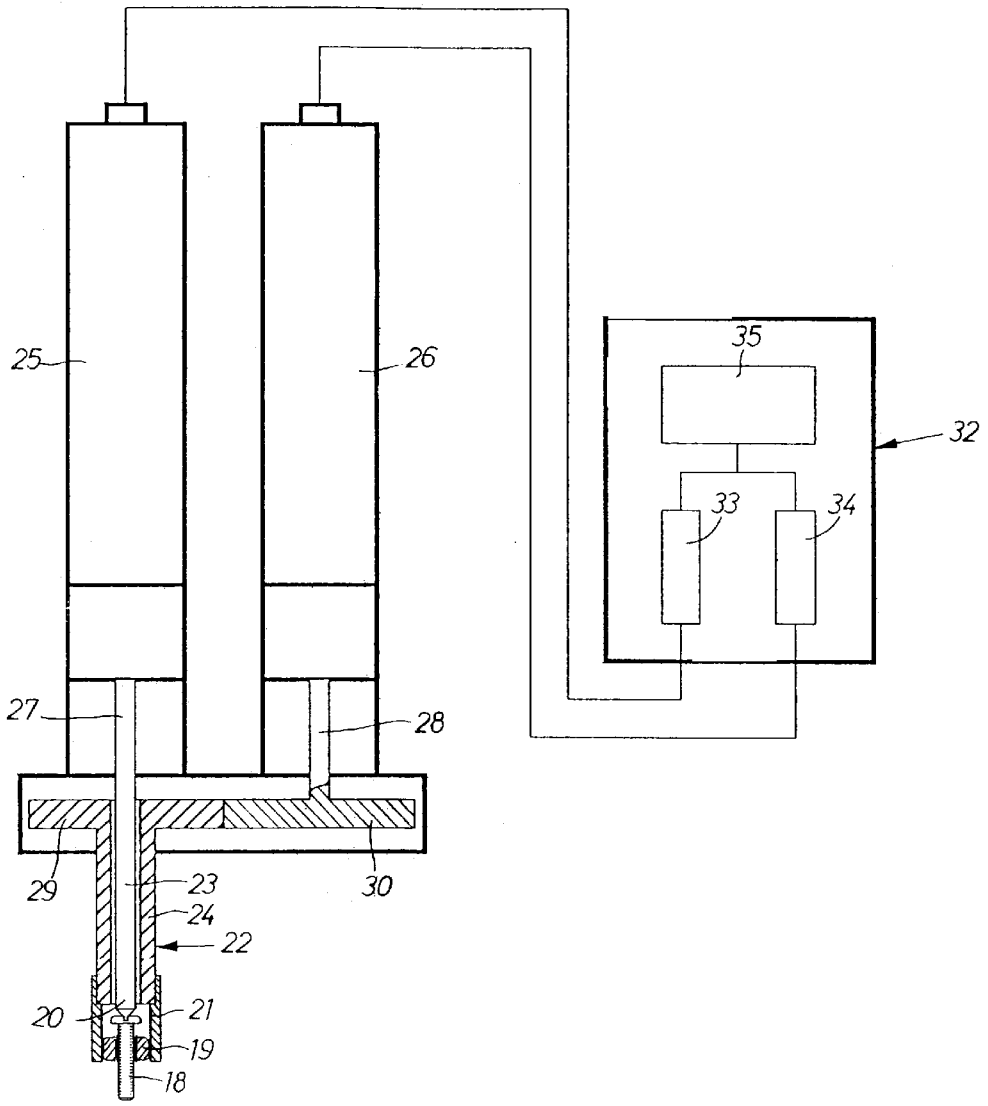
FIG. 5 illustrates schematically a lash setting device as a part of the lash setting technique according to the invention.

The above related procedure is illustrated in FIG. 4, which is a torque/movement-diagram with a curve plotted during a practical valve lash setting operation. The curve starts from the origo of the diagram and shows a slight increase in torque and a quite sudden torque increase up to 0.7 Nm where the first tightening sequence is interrupted. After having backed off about 60 degrees, the adjuster screw 18 is re-tightened to 0.7 Nm to get a more accurate indication of the snug torque level $T_s$, or rather, the angular position $S_o$ of the adjuster screw 18 corresponding to the snug torque level $T_s$ and in which the valve lash is zero.

Having explored the snug torque position $S_s$ the adjuster screw 18 is operated over 90 degrees to fully open the valves 11*a*,11*b*, thereby checking the free movement of the valves and the torque required not exceeding 1.3 Nm. After having backed off the adjuster screw 18 over 130 degrees, the adjuster screw 18 is re-tightened to the snug level $T_s$ and, hence, the zero lash position $S_o$ Finally the adjuster screw 18 is backed off over 170 degrees to the valve lash setting point $S_s$ wherein the desired valve lash is obtained.

According to this new method a correct valve lash setting can be obtained without using feeler gauges and depth sensing probes, but by controlling the process via predetermined torque and angle values coupled to the drive spindles and by compensating for mechanical drive spindle lashes. This means that the method and device according to the invention is advantageous as being much simpler and far less sensitive to environmental factors at the working site than previous techniques for this purpose.

Figure 2A:
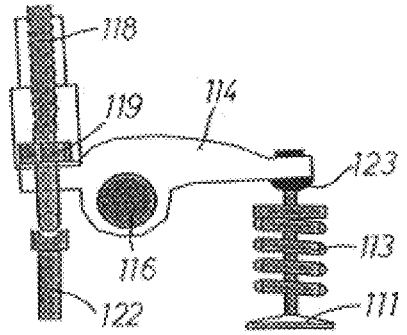
Figure 2B:
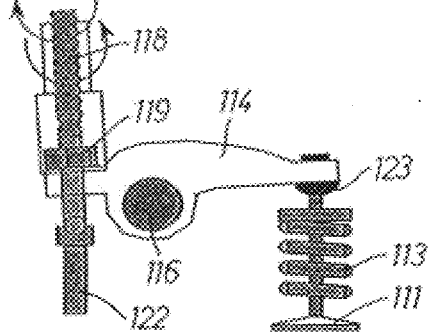
Figure 2C:
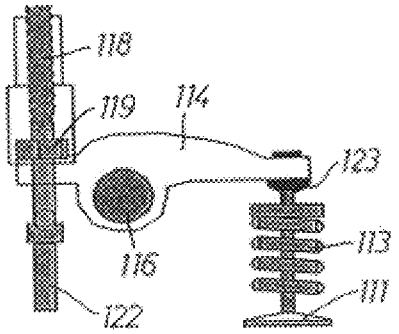

In the application illustrated in FIGS. 2*a–c* the valve lashes are to be set on an I.C. engine having a push rod operated singe valve arrangement. The valve arrangement comprises a valve 112 biassed by a spring 113 towards a closed position, a rocker 114 pivoted on a rocker spindle 116, and a push rod 122. At its one end, the rocker 114 is provided with a valve engaging head 123, and at its other end the rocker 114 carries an adjuster screw 118 for cooperation with the push rod 122. A lock nut 119 is threaded onto the adjuster screw 118 for arresting the latter relative to the rocker 114 as desired.

For setting the valve lash, a co-axial double spindle of the same design as described above is used, thereby applying the inner spindle 31 on the adjuster screw 118 and the outer spindle 32 on the lock nut 119. The lash setting procedure is identical to the above described method and will not be repeated.

Figure 3:
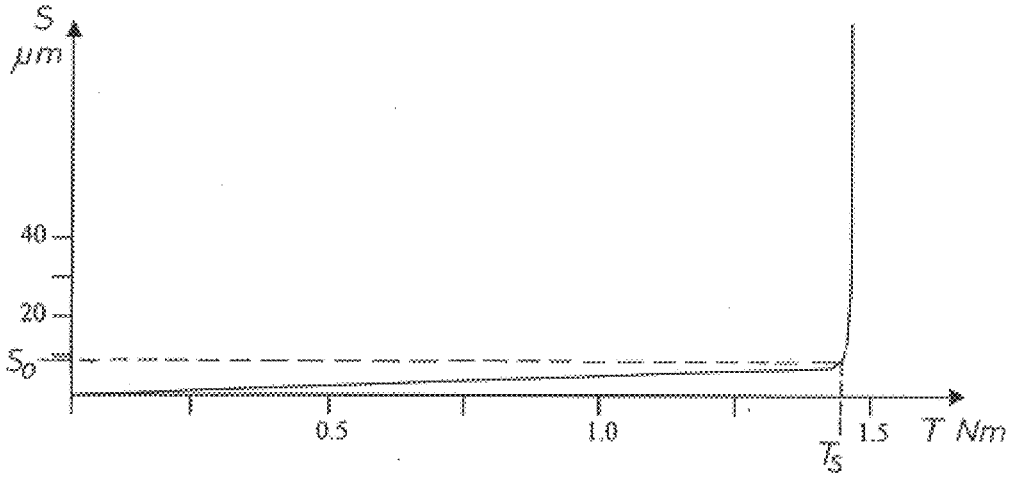
FIG. 3 shows a diagram illustrating the attainment of a snug torque level at adjuster screw tightening.

However, the valve lash setting procedure is illustrated by the charts shown in FIGS. 3 and 4. In FIG. 3, there is illustrated the valve movement S in relation to applied torque T. In the left part of the diagram there is illustrated the deformation of parts of the valve mechanism up to the snug torque level $T_s$ where the valve closing spring load is taken over by the adjuster screw 18 and the valve or valves start opening. In the illustrated case, this occurs at a torque level of about 1.45 Nm. The deformation of the parts of the valve mechanism is about 0.01 mm. Above the snug torque level, in the right hand part of the diagram, the valve or valves start opening. This is illustrated by a steep increase of the valve movement.

What is claimed is:

1. Method for setting the valve lash to a desired value in a piston type I. C. engine by means of a power operated setting device including at least one co-axial double spindle (22), wherein each valve (11*a*,11*b*;111) is operated via a mechanism including an adjuster screw (18) and a lock nut (19), comprising the following consecutive steps:

a) arrange the adjuster screw (18) in a position leaving a valve lash, b) apply the inner spindle (23) of said co-axial double spindle (22) to the adjuster screw (18) and the outer spindle (24) of said co-axial double spindle (22) to the lock nut (19), and tighten the lock nut (19) via said outer spindle (24) to a predetermined initial torque level, c) loosen the lock nut (19) through a predetermined first angle, d) tighten the adjuster screw (18) via said inner spindle (23) to a snug torque level ($T_S$) and register the angular position ($S_o$) of the adjuster screw (18) when said snug torque level ($T_s$) is reached, e) open the valve (11*a*, 11*b*;111) by tightening the adjuster screw (18) through a predetermined second angle while checking the torque magnitude required therefor, f) reverse the adjuster screw (18) through a predetermined third angle exceeding said second angle, g) re-tighten the adjuster screw (18) to said snug torque level ($T_s$), h) reverse the adjuster screw (18) through a predetermined fourth angle corresponding to the desired valve lash, and i) hold the adjuster screw (18) stationary while tightening the lock nut (19) to a predetermined final torque level.

2. Method according to claim 1, wherein said snug torque level ($T_s$) represents the zero lash with the valve (11*a*, 11*b*;111) in closed position and is determined as a significant change in the torque magnitude required to tighten the adjuster screw (18).

3. Method according to claim 1, wherein the torque magnitude required for tightening the adjuster screw (18) through said second predetermined angle should be within a predetermined interval.

4. Method according to claim 1, wherein after step b) the total mechanical rotational lash in the drive line (27) of said inner spindle (23) is determined.

5. Lash setting device for carrying out the method of claim 1, comprising at least one motor driven coaxial double spindle (22) with an inner spindle (23) for operating the adjuster screw (18) and an outer spindle (24) for operating the lock nut (19), each of said at least one coaxial double spindles (22) having two rotation motors (25,26) for individual operation of said inner spindle (23) and said outer spindle (24), means for sensing delivered torque and angular displacement of said inner and outer spindles (18,19), and a programmable control unit (32) arranged to supply power to said two rotation motors (25,26) in relation to a programmed strategy and those torque and angle values detected by said sensing means.

6. Lash setting device according to claim 5, wherein said control unit (32) comprises two motor drives (33,34) each connected to one of said rotation motors (25,26), and said torque sensing means comprises a current sensing function in each one of said motor drives (33,34).

7. Method according to claim 2, wherein the torque magnitude required for tightening the adjuster screw (18) through said second predetermined angle should be within a predetermined interval.

8. Lash setting device for carrying out the method of claim 2, comprising at least one motor driven coaxial double spindle (22) with an inner spindle (23) for operating the adjuster screw (18) and an outer spindle (24) for operating the lock nut (19), each of said at least one coaxial double spindles (22) having two rotation motors (25,26) for individual operation of said inner spindle (23) and said outer spindle (24), means for sensing delivered torque and angular displacement of said inner and outer spindles (18,19), and a programmable control unit (32) arranged to supply power to said two rotation motors (25,26) in relation to a programmed strategy and those torque and angle values detected by said sensing means.

9. Lash setting device for carrying out the method of claim 3, comprising at least one motor driven coaxial double spindle (22) with an inner spindle (23) for operating the adjuster screw (18) and an outer spindle (24) for operating the lock nut (19), each of said at least one coaxial double spindles (22) having two rotation motors (25,26) for individual operation of said inner spindle (23) and said outer spindle (24), means for sensing delivered torque and angular displacement of said inner and outer spindles (18,19), and a programmable control unit (32) arranged to supply power to said two rotation motors (25,26) in relation to a programmed strategy and those torque and angle values detected by said sensing means.

10. Lash setting device for carrying out the method of claim 4, comprising at least one motor driven coaxial double spindle (22) with an inner spindle (23) for operating the adjuster screw (18) and an outer spindle (24) for operating the lock nut (19), each of said at least one coaxial double spindles (22) having two rotation motors (25,26) for individual operation of said inner spindle (23) and said outer spindle (24), means for sensing delivered torque and angular displacement of said inner and outer spindles (18,19), and a programmable control unit (32) arranged to supply power to said two rotation motors (25,26) in relation to a programmed strategy and those torque and angle values detected by said sensing means.

11. Lash setting device for carrying out the method of claim 7, comprising at least one motor driven coaxial double spindle (22) with an inner spindle (23) for operating the adjuster screw (18) and an outer spindle (24) for operating the lock nut (19), each of said at least one coaxial double spindles (22) having two rotation motors (25,26) for individual operation of said inner spindle (23) and said outer spindle (24), means for sensing delivered torque and angular displacement of said inner and outer spindles (18,19), and a programmable control unit (32) arranged to supply power to said two rotation motors (25,26) in relation to a programmed strategy and those torque and angle values detected by said sensing means.

12. Lash setting device according to claim 8, wherein said control unit (32) comprises two motor drives (33,34) each connected to one of said rotation motors (25,26), and said torque sensing means comprises a current sensing function in each one of said motor drives (33,34).

13. Lash setting device according to claim 9, wherein said control unit (32) comprises two motor drives (33,34) each connected to one of said rotation motors (25,26), and said torque sensing means comprises a current sensing function in each one of said motor drives (33,34).

14. Lash setting device according to claim 10, wherein said control unit (32) comprises two motor drives (33,34) each connected to one of said rotation motors (25,26), and said torque sensing means comprises a current sensing function in each one of said motor drives (33,34).

15. Lash setting device according to claim 11, wherein said control unit (32) comprises two motor drives (33,34) each connected to one of said rotation motors (25,26), and said torque sensing means comprises a current sensing function in each one of said motor drives (33,34).

* * * * *